US005131418A

United States Patent [19]

Vaccaro

[11] Patent Number: 5,131,418

[45] Date of Patent: Jul. 21, 1992

[54] COMB FOR USE WITH HAIR CUTTING

[76] Inventor: John Vaccaro, 7 Brookdale Rd., Mahopac, N.Y. 10541

[21] Appl. No.: 763,572

[22] Filed: Sep. 23, 1991

[51] Int. Cl.[5] ..... A45D 24/34

[52] U.S. Cl. ..... 132/213.1; 132/152; 132/154

[58] Field of Search ..... 132/143, 148, 150, 152, 132/154, 159, 213, 213.1, 214, 219

[56] References Cited

U.S. PATENT DOCUMENTS

| | | | |
|---|---|---|---|
| 1,451,562 | 4/1923 | Babcock | 132/213 |
| 1,457,726 | 6/1923 | Cornellier | 132/213 |
| 1,465,455 | 8/1923 | Owen | 132/150 |
| 2,556,805 | 6/1951 | Forward | 132/213.1 |
| 2,687,134 | 8/1954 | Bayer | 132/214 |
| 2,879,777 | 3/1959 | Miller | 132/213.1 |
| 3,055,376 | 9/1962 | Walls | 132/213 |
| 3,277,902 | 10/1966 | Korst | 132/214 |
| 3,382,877 | 5/1968 | Cercone | 132/213.1 |
| 3,572,351 | 3/1971 | Perry | 132/213.1 |
| 4,345,608 | 8/1982 | Cavaioli et al. | 132/219 |
| 4,867,184 | 9/1989 | Davis | 132/150 |
| 4,926,891 | 5/1990 | Fani et al. | 132/213 |

*Primary Examiner*—Gene Mancene
*Assistant Examiner*—Frank A. LaViola
*Attorney, Agent, or Firm*—Israel Nissenbaum

[57] ABSTRACT

A comb for precision cutting of hair to specific length. The comb comprises a standard main body portion with parallel teeth, extending from a base, and thickened end sections which laterally enclose the teeth. Extending from one of the end sections is a handle member, offset from the plane of the teeth by a sufficient distance such that fingers, which grip the handle member, are kept from contacting the scalp. The offset handle keeps the user's fingers off the scalp, thereby preventing inadvertent end tipping of the comb. The handle member is also laterally offset to the rear of the comb for enhanced ergonomic handling, to permit better visibility of the hair being cut and to remove the fingers out of line with the clippers or scissors. The main body portion further comprises pedestal stand-off elements such as flat sided protrusions integrated with the sides of the teeth and/or end sections which are placed directly on a scalp. The pedestal stand-off elements maintain the teeth of the comb a predetermined distance from the scalp, and also provide a stable support for the teeth, to prevent inadvertent tilting movement of the teeth relative to the scalp. In use, the main body portion of the comb is placed directly on a scalp, with hair then being combed between the teeth. A cutting implement such as scissors or a clipper, placed directly on the scalp-supported teeth, is then used to cut hair extending from between the teeth to a precisely predetermined length equal to the combined thickness of the comb teeth and the pedestal elements.

15 Claims, 2 Drawing Sheets

FIG.1
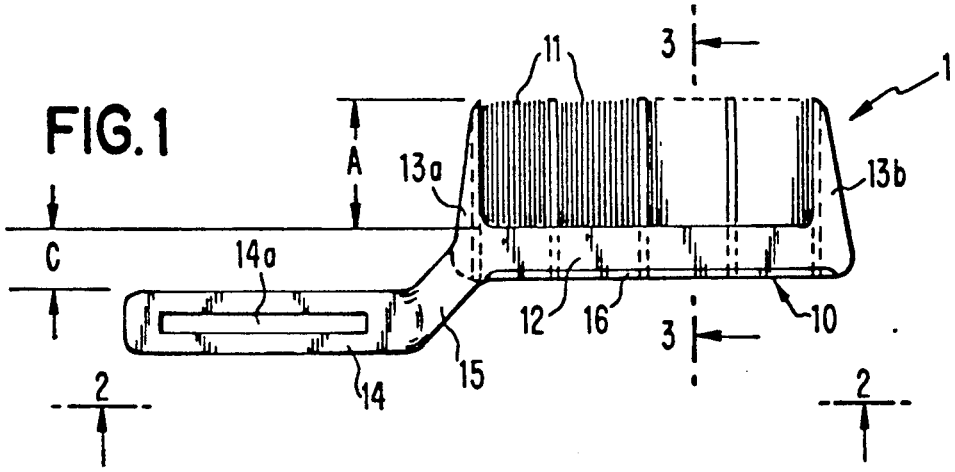
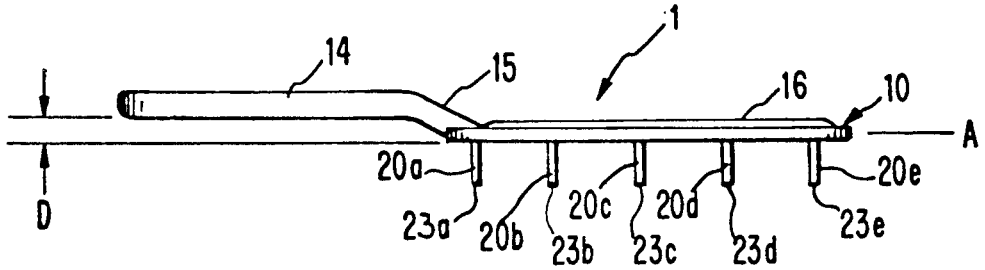
FIG.2
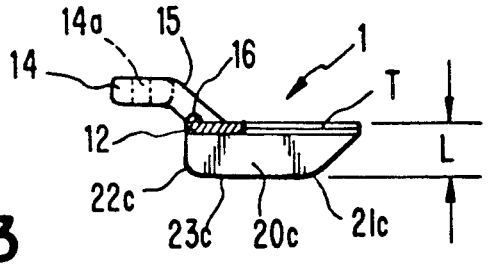
FIG.3
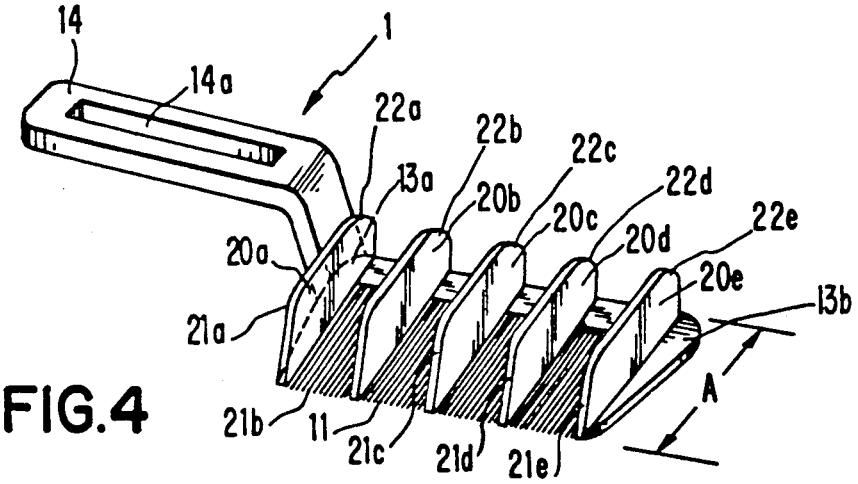
FIG.4

COMB FOR USE WITH HAIR CUTTING

This invention relates to combs used by barbers and/or hair stylists and particularly to combs used as guides for cutting of hair.

In the cutting of hair, combs are generally utilized as inexact instruments. The barber or hair stylist combs a section of hair, lifts it to a specific estimated height and cuts it at the estimated height. The more skillful the barber or hair stylist at consistently estimating hair length, the more even the hair cut. Some radical devices such as a device for aiding in the cutting of "flat-top" hair styles are designed for cutting specific lengths of hair. However these devices are cumbersome and heavy. The "flat-top" device is almost shovel-like in configuration and unwieldyness. Other devices such as the one described in U.S. Pat. No. 2,687,134 facilitate the graduated cutting of hair at an angle but do not readily permit cutting of hair at a single uniform length.

It is an object of the present invention to provide a lightweight, easy to use, comb which eliminates estimation for consistent exact uniform cutting lengths.

It is a further object of the present invention to provide such comb as a stable base for an exact cutting guide for scissors or clippers to a specific pre-determined length.

It is another object of the present invention to provide a series of combs which provide guides for cutting of hair to different predetermined lengths as a kit for exact hair cutting to different lengths.

It is a still further object of the present invention to provide such combs with offset handles to keep the user's fingers at distance from the head and the comb, whereby the comb can be maintained as a steady base for the scissors or clippers and wherein a second offset facilitates ergonomic utilization and visibility of the hair being cut.

These and further objects, features and advantages of the present invention will become more evident from the following discussion as well as the drawings in which:

FIG. 1 is a top view of the comb of the present invention (with some teeth shown removed for clarity);

FIG. 2 is a side elevation view of the comb in FIG. 1 along line 2—2;

FIG. 3 is an end view taken along line 3—3 of FIG. 2;

FIG. 4 is a bottom isometric view of the comb of the present invention showing the pedestal stand-off elements;

Figure 5:
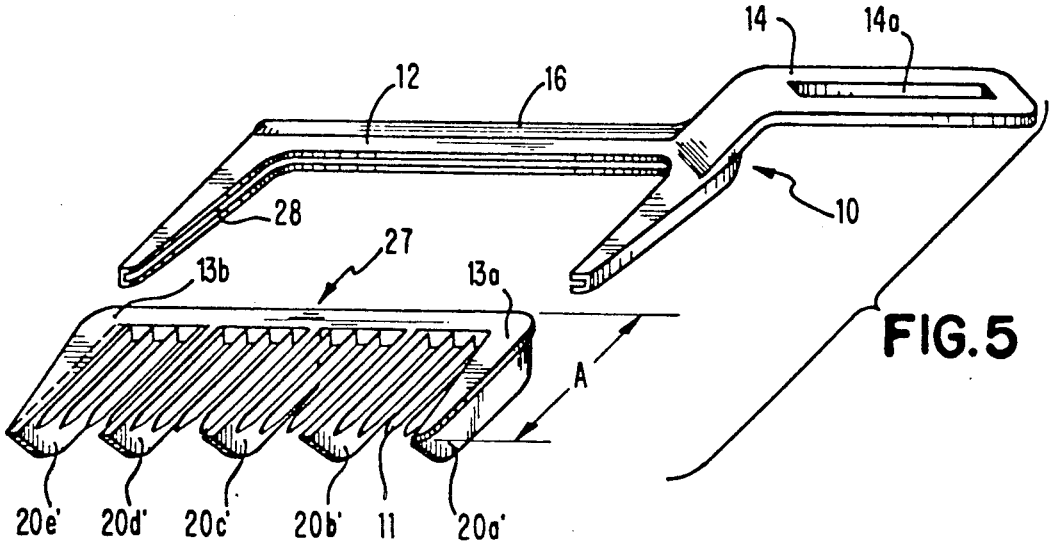
FIG. 5 shows an embodiment of the present invention wherein comb elements with different size pedestal stand-offs are replaceable for cutting hair to different lengths.

Generally the present invention comprises a comb for precision cutting of hair to specific length. The comb comprises a main body portion with parallel teeth of uniform thickness (relative to each other) arranged along a longitudinal plane, and extending axially from a base member. It is preferred, as with common combs, to protect the teeth, with end sections, in the form of thickened teeth, which laterally enclose the end teeth. In accordance with the present invention, the main body portion further comprises pedestal stand-off means integrated with two or more of the teeth and/or end sections and extending substantially perpendicularly from the longitudinal plane of the teeth. The pedestal stand-off means maintain the teeth of the comb a predetermined distance from a scalp when the comb rests directly on the scalp in a position wherein the plane of the teeth is parallel to the scalp. Combed hair extending between the teeth of the comb is cut by a cutting implement such as a scissors or a clipper, placed directly on the scalp-supported teeth. The cutting implement, at the upper surface of the teeth, thereby cuts hair to a predetermined uniform length equal to the thickness of the teeth and the height of the pedestal stand-off means. The pedestal stand-off means also provide a stable support for the teeth. This prevents inadvertent tilting movement of the teeth, relative to the scalp, and uneven hair cutting, particularly under weight of a clipper or scissor placed directly on the teeth.

Extending from the main body portion or one of the end sections is a handle member which is preferably offset, in a direction opposite to the pedestal stand-off means, and parallel to the plane of the teeth, by a distance from the ends of the pedestal stand-off means (and the scalp), of at least that of the thickness of fingers which grip the handle member. Generally the offset is at least about ½" (13 mm) and up to about 1"(25 mm). The offset handle prevents inadvertent edge tipping of the comb which may be occasioned by finger contact with the scalp. In addition, or alternatively, the handle is also preferably offset laterally to the rear of the main body of the comb. With this secondary offset configuration, ergonomics of handling the comb are improved. In addition, fingers of the manipulating hand are removed from obstructing a clear view of the comb and cutting operation and are also removed from actually obstructing the cutting operation.

In a preferred embodiment, the pedestal stand-off means comprises flat sided elements or protrusions, each extending along a substantial portion of the length of two or more of the teeth and/or protective end sections. The flat sided protrusions, are of a predetermined height and preferably have a width no more than that of the comb tooth or end section, whereby combing is not impeded thereby. The predetermined height, taken in conjunction with the thickness of the supporting tooth or end section is equal to the desired cutting length. Combs with protrusions of differing heights provide for different desired cutting lengths. The protrusions can either be directly integrated with the teeth and/or end section or they can be interchangeably fastened and removed from the teeth and/or end sections in the manner of a cassette by any of a number of common means such as mating tongue and groove elements, lateral clips, etc. For ease of interchangeability it is more preferred that the entire comb section, with different size pedestal stand-offs, be removable and insertable in a handle receptacle. The protrusion, on an end section or tooth, need not be unitary or completely solid but may consist of a series of small protrusions, each of the same height, as long as a stable base is provided thereby.

In order to compensate for the normal curvature of a head, the main body portion of the comb is preferably no longer than four inches (102 mm) and the pedestal stand-off elements are separated from each other by a maximum distance of 1" (25 mm), though a large number of protrusions, if they are closely spaced, can make the comb too heavy and unwieldy for proper use. Accordingly, it is preferred that the ratio of pedestal stand-off elements to teeth of the comb should be less than 1:2 and more preferably less than 1:8 (even less if the comb is fine toothed). Comb teeth vary in number from 7/inch to 11/inch with 9/inch being preferred for lightness and ability to resist dipping of the clipper into spacings. The desired heights for cutting (thickness of the teeth plus the height of the pedestal stand-off elements) is preferably in increments of ¼" (6 mm), with preferred heights in a kit of several combs of ¼" (6 mm), ½" (13 mm), ¾" (19 mm), and 1" (25 mm). To ensure a stable pedestal for support of the comb it is preferred that the length of the pedestal stand-off elements, coextensive with the teeth or end sections, be at least about 1" (25 mm) and more preferably about 1.25" (32 mm). Though the heights of the pedestal stand-off elements should be uniform, their lengths need not be uniform. Thus, in order to minimize excessive weight caused by the pedestal stand-off elements, centrally located stand-off elements may be slightly shortened.

To facilitate cutting, the upper surface of the teeth of the comb is preferably substantially flat (with no more than a slight taper). To facilitate combing and separation of hair, it is preferred that both the lower surface of the teeth and the forward edge of the pedestal stand-off elements are sloped. A slight graduation or sloping of the comb teeth, i.e. the teeth end in a point, permits for easier combing and separation of hair, and in fact standard combs are constructed in this manner. Bevelling or rounding of the pedestal stand-off elements, particularly those of larger heights, minimizes possible painful gouging of the head. The rear of the pedestal stand-off elements are either rounded or bevelled to permit the comb to be readily swivelled up in effecting proper blending.

To further aid in exact cutting, a guide rail extends perpendicularly along the length of the base of the teeth of the comb. A cutting implement, particularly a clipper, is placed against the guide rail and is then drawn along the upper surface of the comb teeth to effect the exact length cutting. For use with a clipper, the length of the comb teeth should be at least equal to the width of the clipper head to fully support the clipper. This prevents uneven edge cutting by a free end of the clipper. To ensure such complete support it is preferred that the length of the teeth exceed the width of the clipper by at least ¼" (6 mm).

Unlike rat-tail handles which are held between the finger tips, the handle of the comb of the present invention should be fully gripped to exert the requisite control to fully and firmly hold the comb in position directly against the scalp. Accordingly, the handle is preferably dimensioned in a rectangular shape or fully or partially circular shape suitable for a full comfortable grip. Since the handle is fully gripped, the fingers of the hand would normally impede placement of the comb fully against the scalp. To obviate possible tipping of the comb, the handle is offset from the plane of the teeth by a distance sufficient to keep the user's fingers away from the scalp when the comb is fully seated on the scalp. To maintain a light weight, it is preferred that the handle not be solid. In addition, it is preferred that the comb be constructed of strong light weight plastic or aluminum.

Figure 6:
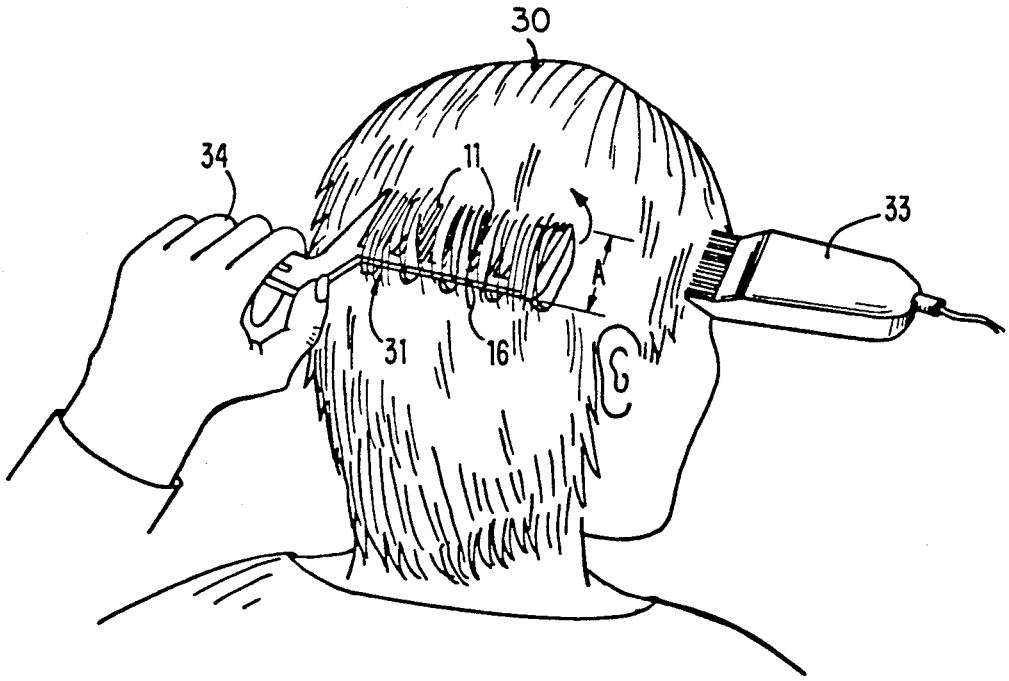
FIG. 6 shows the comb of FIGS. 1-4 being used as a guide for cutting hair.

With specific reference to the drawings, in FIGS. 1 and 4, comb 1 is shown with a main comb body 10 having standard comb teeth 11 extending from a base 12 and arranged in a plane A. The teeth are peripherally enclosed, in plane A, by end thickened tooth sections 13*a* and 13*b*. As seen in FIG. 2, elongated rectangular handle 14 is connected to the main comb body 10 by angled connection element 15 whereby it is parallel to the teeth 11 and offset therefrom by a distance D sufficient to allow finger enclosure of the handle 14 to prevent contact of the fingers with the scalp. As shown in FIG. 6, there is no extension of the fingers 34 into or beyond the plane A of the teeth of the comb. The handle 14 has central cut-out 14*a* to minimize weight and facilitate handling with reduction of fatigue without affecting structural capability and strength. The comb 1, as shown, constructed of plastic, has a weight of no more than about two ounces (57 gms).

As shown more clearly in FIG. 4, beneath both end sections 13*a* and 13*b* and extending along a substantial portion of their respective lengths are pedestal stand-off elements 20*a* and 20*e* with flat base surfaces 23*a* and 23*e* respectively. Equally separated by a distance of about 1" (25 mm) from pedestal stand-off elements 20*a* and 20*e* and each other are pedestal stand-off elements 20*b–d*, which are similarly positioned under three of the teeth 11. The main comb body 10 is shown as having a standard 4" (102 mm) length. The pedestal stand-off elements 20*a–e* are all positioned in close proximity to the base 12 and extend away from the base. Centrally positioned pedestal stand-off elements 20*b–d* are somewhat shorter than stand-off elements 20*a* and 20*e* since they do not provide as much pedestal support. As seen in FIG. 2 in phantom, pedestal stand-off elements 20*a–e* may be of uniform differing heights. The pedestal elements are shown with rounded ends 21*a–e* and 22*a–e* respectively. Rounded ends 21*a–e* permit smoother combing and prevent gouging of the scalp. Rounded ends 22*a–e* permit the comb 1 to be swivelled thereon in the direction of the arrow, shown in FIG. 6, for hair blending.

In operation, as shown in FIG. 6, a section of hair 31 is combed by the tapered ends of teeth 11 with combed hair entering between the teeth. In this regard it may be noted that the pedestal elements 20*a–e*, as clearly seen in FIG. 2, are sized, beyond the point 11*a* where the teeth begin to taper, in order to maintain a uniform supporting height. The comb 1 is then pushed onto the scalp 30 with even downward pressure being exerted on the comb body 10. Offset D above the plane of the teeth and offset C to the rear of the comb permit easier manipulative handling of the comb in this regard. When the comb is resting on the pedestal element 20*a–e*, hair extending between teeth 11 is cut with clipper 33. Clipper 33 is placed upon the substantially flat upper surface of teeth 11 and is guided against cutting guide rail 16 to cut the combed hair to a length L equal to the height of the pedestal (in FIG. 3 various pedestal element heights are shown) plus the thickness T of the teeth 11. The comb is repositioned until all the hair is cut to the desired length. A kit of, for example, 4 combs, differing only in pedestal element height as shown in FIG. 3, provides a barber or hair stylist with the ability to accurately and consistently cut various lengths of hair in increments such as ¼" as shown.

The pedestal stand-off elements 20*a–e* are shown as integrally molded together with the teeth 11 and end sections 13*a* and 13*b*. However, such pedestal elements may be part of a separate element as shown in FIG. 5 wherein cassette-like comb element 27 with pedestal elements 20*a'–e'* is shown as being capable of sliding onto comb body 10 via groove 28. Interchangeable pedestal elements of different heights may be used in place of entirely separate combs.

It is understood that the above examples and drawings are only illustrative of the present invention and that changes in structure and relative dimensions and the like may be made without departing from the scope of the invention as defined in the following claims.

What is claimed is:

1. A comb for precision cutting of hair to specific length, comprising a main body portion with parallel teeth arranged in a plane, and extending axially from a base; at least one tooth end section which laterally encloses the teeth; and a handle member extending from said main body portion, wherein the improvement comprises the main body portion further comprising pedestal stand-off elements affixed to at least two, but not all, of either or both of said teeth and said end sections, wherein said pedestal stand-off elements lift and maintain the teeth of the comb a single uniform predetermined distance from a scalp upon which said comb is placed, with hair combed and held by said teeth being cut by a cutting device placed upon said teeth, said pedestal stand-off elements further providing an integral stable support for the teeth to prevent inadvertent tilting movement of the teeth, relative to the scalp, during said cutting.

2. The comb of claim 1 wherein said pedestal stand-off elements comprise protrusions having a flat side adjacent the scalp on which it is adapted to be placed, said protrusions being integrated with and extending substantially perpendicularly from the longitudinal plane of the teeth, each of said protrusions extending along a substantial portion of the length of at least two of the teeth and end sections, and said protrusions having a width no more than that of the tooth and end section to which it is integrated.

3. The comb of claim 2 wherein said handle member is offset from the plane of the teeth, in a direction opposite that of extension of the protrusions, by a distance, from the end of the protrusions which contact the scalp, sufficient to keep fingers holding the handle from contacting the scalp when the protrusions are in contact with the scalp.

4. The comb of claim 3 wherein said distance ranges between ½" (19 mm) to 1" (25 mm).

5. The comb of claim 4 wherein said handle member is also laterally offset to the rear of the main body of the comb whereby the handle member is removed from obstructing cutting by the cutting member and from obstructing viewing of such cutting.

6. The comb of claim 5 wherein said comb is comprised of aluminum.

7. The comb of claim 4 wherein said handle member is substantially rectangular.

8. The comb of claim 7 wherein said rectangular handle member has an open central portion therein.

9. The comb of claim 1 wherein said handle member is laterally offset to the rear of the main body of the comb whereby the handle member is removed from obstructing cutting by the cutting member and from obstructing viewing of such cutting.

10. The comb of claim 3 wherein said main body member further comprises a guide rail which extends perpendicularly away from the plane of the teeth, in a direction opposite that of the protrusions, along the length of the base, and adapted for use whereby a cutting implement is placed against the guide rail and is then guided along an upper surface of the teeth to effect the exact length cutting.

11. The comb of claim 4 wherein the longitudinal ends of the protrusions are rounded.

12. The comb of claim 2 wherein the ratio of protrusions to teeth is no more than 1:2.

13. The comb of claim 12 wherein the ratio of protrusions to teeth is no more than 1:8.

14. The comb of claim 1 wherein the main body portion comprises a receptacle section and a separable section comprised of the parallel teeth and the pedestal stand-off elements, with said separable section being fitted into engagement with said receptacle section.

15. The comb of claim 14 wherein said receptacle section comprises a groove into which said separable section is interfitted.

* * * * *